US005353569A

United States Patent [19]

Rodrique

[11] Patent Number: 5,353,569

[45] Date of Patent: Oct. 11, 1994

[54] CONSTRUCTION BLOCK WITH GUIDING SYSTEM FOR WALLS

[75] Inventor: Jacques Rodrique, Mont eal-Nord, Canada

[73] Assignee: Transpave Inc., Quebec, Canada

[21] Appl. No.: 983,061

[22] Filed: Nov. 27, 1992

[30] Foreign Application Priority Data

Jul. 10, 1992 [CA] Canada ..... 2073638

[51] Int. Cl.[5] ..... E04C 1/10

[52] U.S. Cl. ..... 52/589.1; 52/604; 52/608; 52/609; 52/612

[58] Field of Search ..... 52/589, 612, 604, 608–610; 405/284, 285, 286

[56] References Cited

U.S. PATENT DOCUMENTS

| | | | |
|---|---|---|---|
| 1,334,599 | 3/1920 | Cusick . | |
| 2,111,003 | 3/1938 | Petty . | |
| 2,313,363 | 3/1943 | Schmitt . | |
| 2,957,278 | 10/1960 | Woodworth . | |
| 3,435,576 | 4/1969 | Giannelia . | |
| 3,834,108 | 9/1974 | Ludvigsen . | |
| 3,996,715 | 12/1976 | Dowse . | |
| 4,034,533 | 7/1977 | Faas | 52/589 |
| 4,075,808 | 2/1978 | Pearlman | 52/589 X |
| 4,429,506 | 2/1984 | Henderson | 52/589 |
| 4,583,341 | 4/1986 | Barth et al. . | |
| 4,619,560 | 10/1986 | Crinnion | 52/604 X |
| 4,627,209 | 12/1986 | Schwartz | 52/589 |
| 4,703,599 | 11/1987 | Pardo | 52/604 X |
| 4,833,855 | 5/1989 | Winter | 52/612 X |
| 4,854,097 | 8/1989 | Haener | 52/612 X |
| 4,854,103 | 8/1989 | Klum | 52/589 X |
| 4,887,403 | 12/1989 | Bonner . | |
| 5,181,362 | 1/1993 | Benitez | 52/589 X |

*Primary Examiner*—Carl D. Friedman
*Assistant Examiner*—Beth A. Aubry
*Attorney, Agent, or Firm*—Ronald S. Kosie; Robert Brouillette

[57] ABSTRACT

An interlocking block for use in the construction of a mortarless retaining wall wherein a plurality of interlocking blocks are stacked in a number of successive offset courses of blocks, a block in an upper row being in overlapping relation with respect to the joint between blocks in an immediately underlying row. The interlocking block comprises an interlocking member and a block body having top and bottom support surfaces and rear, front and side surfaces. The interlocking member has an interlock surface configured so that when the interlocking block is disposed over the joint between two underlying interlocking blocks, the interlock member is able to engage the upper edge surface portion of each such underlying block such that the front surface of the block is offset rearwardly with respect to the front surfaces of the underlying blocks and when the interlocking block is disposed over the joint between two underlying interlocking blocks, curved walls can be created without the necessity of providing different types of blocks for different types of applications.

13 Claims, 13 Drawing Sheets

CONSTRUCTION BLOCK WITH GUIDING SYSTEM FOR WALLS

BACKGROUND OF THE INVENTION

It is common practice in the construction of a flat wall to erect same with courses of blocks having generally flat top and bottom faces placed in horizontal courses one upon the other in end to end relation. However, when a rounded (concave or convex) wall is desired, such blocks are also laid in horizontal courses, but are manually rotated so as to obtain the desired configuration of wall. Since laying blocks constitute a big portion of the direct labor cost and this adjustment is manually accomplished, such practice is time consuming and therefore, expensive. Furthermore, the results vary from one worker to another.

In addition, for the construction of walls of non-conventional shape, it was necessary to provide a large number of different types and sizes of building units and the units themselves have been more expensive to manufacture than conventional blocks. Furthermore, in some cases, it was necessary to remove or grind off a portion of the block so as to fit same into the wall, for example in corners.

Several attempts have been in the past to produce a multi-purpose block. It is worthwhile noting the U.S. Pat. No. 1,334,599 (Cusick) and 2,313,363 (Schmitt) in which building blocks are disclosed. These blocks comprise a bead designed to overlap the upper portion of the outer face of a lower block mainly to render the wall water and frost proof. The blocks disclosed in these patents are designed for the construction of a flat wall and thus, do not allow the construction of a rounded wall.

The U.S. Pat. No. 3,996,715 (Dowse) discloses a building block for road surfaces and river linings. Such block comprises an upper portion and a lower portion providing load bearing projections. The lower portion is provided with recesses to allow identical blocks to be interlocked.

Other patents fail to solve the problem of building an economical and sturdy wall structure.

The present invention relates to a block for the construction of a wall and more particularly to a block comprising guiding means used to displace a first block of a subsequent course of blocks with respect to blocks from the next below course of blocks in order to form, easily, rounded or flat walls or a combination of both.

OBJECTS OF THE PRESENT INVENTION

An object of the present invention is to provide a wall made of prefabricated concrete elements, which can be formed largely of extremely simple elements and permits equally simple assembly.

Another object of the present invention is to provide a block for the construction of a wall which does not necessitate the use of mortar, bolts, steel rods or the like to maintain same and which is adaptable to varying conditions.

Still another object of the present invention is to provide a block for the construction of a wall which is being aesthetically pleasing.

Yet another object of the present invention is to provide a block for the erection of a wall comprising guiding means allowing a first block of a subsequent course of blocks to be rotated with respect to the blocks of the next below course of blocks forming the wall.

An even still further object of the present invention is to provide a block having guiding means in accordance with the present invention which may further comprise anchoring means when the said block is used for the construction of a retaining wall.

In accordance with the above objects, the block of the present invention comprises a top, a bottom, a front, a rear and side faces. The bottom face of a block further includes guiding means or an interlocking member extending from same. The bottom face of a block of a subsequent course of blocks also has a complementary shape with respect to the top face of a block from the next below course of blocks so that a relative motion is possible between those blocks. Upon the erection of the wall, the guiding means of a block of the subsequent course of blocks rests on the rear face of at least one block of the next below course of blocks and the guiding means are used to guide such relative movement of each block of the subsequent course of blocks with respect to the next below course of blocks in order to create a wall which can be flat or rounded or a combination of both and this, without the necessity of providing different types of blocks for different types of applications. Further, no special tooling is necessary to install the blocks in accordance to the present invention. In addition, due to the guiding means, each overlying horizontal course is automatically set back from the next below horizontal course.

The invention also comprises such other objects, advantages and capabilities as will later more fully appear and which are inherently possessed by the invention.

SUMMARY OF THE INVENTION

More particularly, the present invention provides an interlocking block for use in the construction of a mortarless retaining wall wherein a plurality of said interlocking blocks are stacked in a number of successive offset courses of blocks, a block in an upper tow being in overlapping relation with respect to the joint between blocks in an immediately underlying row, said interlocking block comprising a block body, and an interlocking member, said block body having top and bottom support surfaces and rear, front and side surfaces, said interlocking member projecting from the bottom surface of the interlocking block adjacent the rear surface thereof, the rear surface of the interlocking block having an upper edge surface portion adjacent the top surface, said interlocking member having an interlock surface configured so that when said interlocking block is disposed over the joint between two said underlying interlocking blocks, the interlock surface is able to engage the said upper edge surface portion of each such underlying block such that the front surface of the block is offset rearwardly with respect to the front surfaces of the underlying blocks, characterized in that in that said upper edge surface portion has a bevelled portion adjacent each side surface of the block and a recessed portion disposed between the bevelled portions, said bevelled and recess portions being configured such that:

i) when said interlocking block is disposed over the joint between two underlying said interlocking blocks so as to define a curved wall segment having a concave exterior wall surface, a portion of said interlock surface adjacent each side surface of the interlocking block is able to engage a respective bevelled portion of the said upper edge surface portion of each such underlying interlocking block such that the front surface of the interlocking block is offset rearwardly with respect to the front surfaces of the underlying interlocking blocks; and ii) when said interlocking block is disposed over the joint between two underlying said interlocking blocks so as to define a curved wall segment having a convex exterior wall surface, a portion of said interlock surface adjacent each side surface of the interlocking block is able to engage a respective recessed portion of the said upper edge surface portion of each such underlying interlocking block such that the front surface of the interlocking block is offset rearwardly with respect to the front surfaces of the underlying interlocking blocks.

DESCRIPTION OF THE DRAWINGS

One exemplary embodiment of the invention is described in more detail below with reference to the drawings in which.

DETAILED DESCRIPTION OF THE PREFERRED EMBODIMENT

Figure 1:
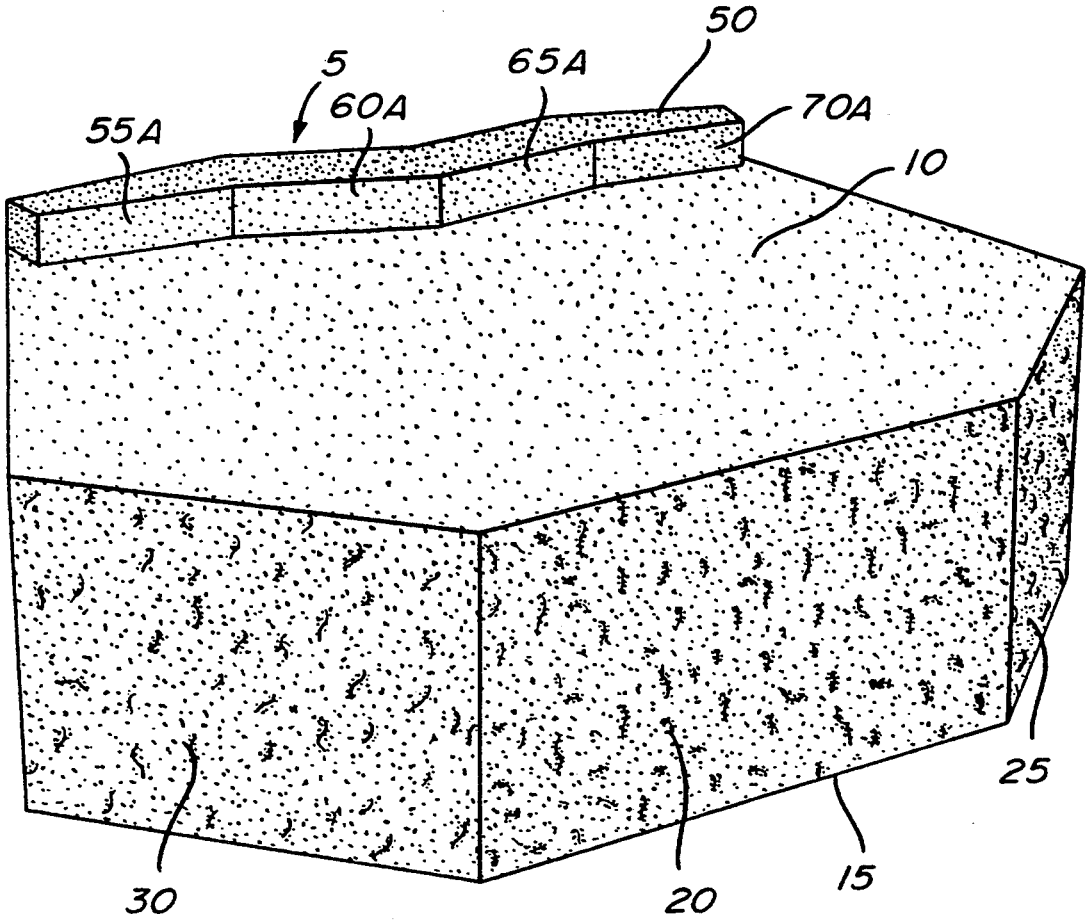
FIG. 1 is a bottom perspective view of a block in accordance with the present invention.

With particular reference to FIGS. 1 to 7, there is shown a block 5 having a generally flat top 15 and bottom 10 surfaces and comprises generally a main hexagonal section divided in six generally flat surfaces 20, 25, 30, 35, 40 and 45. A wall is formed of a plurality of similar blocks disposed in horizontal courses one upon the other in end to end relation to overlap the adjacent ends of the next below course of block 5. The said top 15 and bottom 10 surfaces are of complementary shape to allow a relative movement of one block of one course of blocks with respect to another block of the below course of block. In the embodiment shown, the top 15 and the bottom 10 surfaces are flat. However, the top surface 15 can be provided with a conical protrusion matingly engaging a complementary recess into the bottom surface 10 of the block 5.

Figure 2:
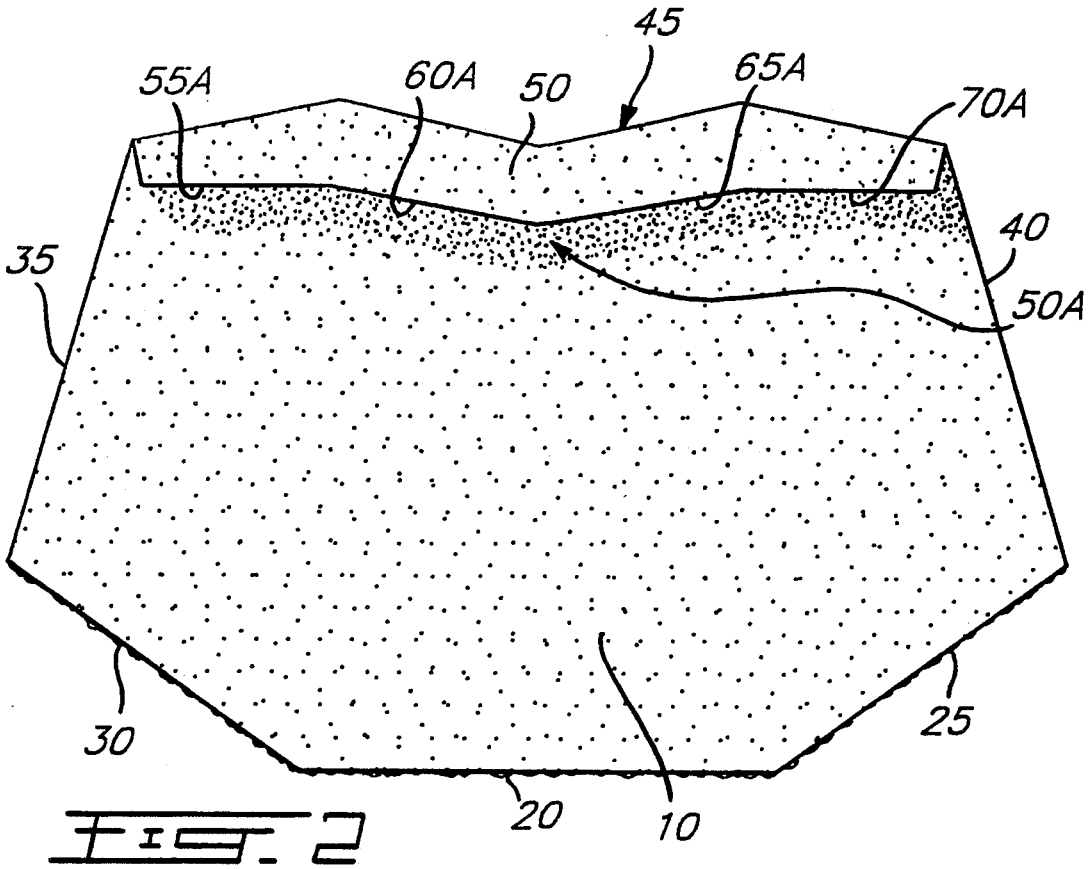
FIG. 2 is a bottom view of the block shown in FIG. 1.
Figure 3:
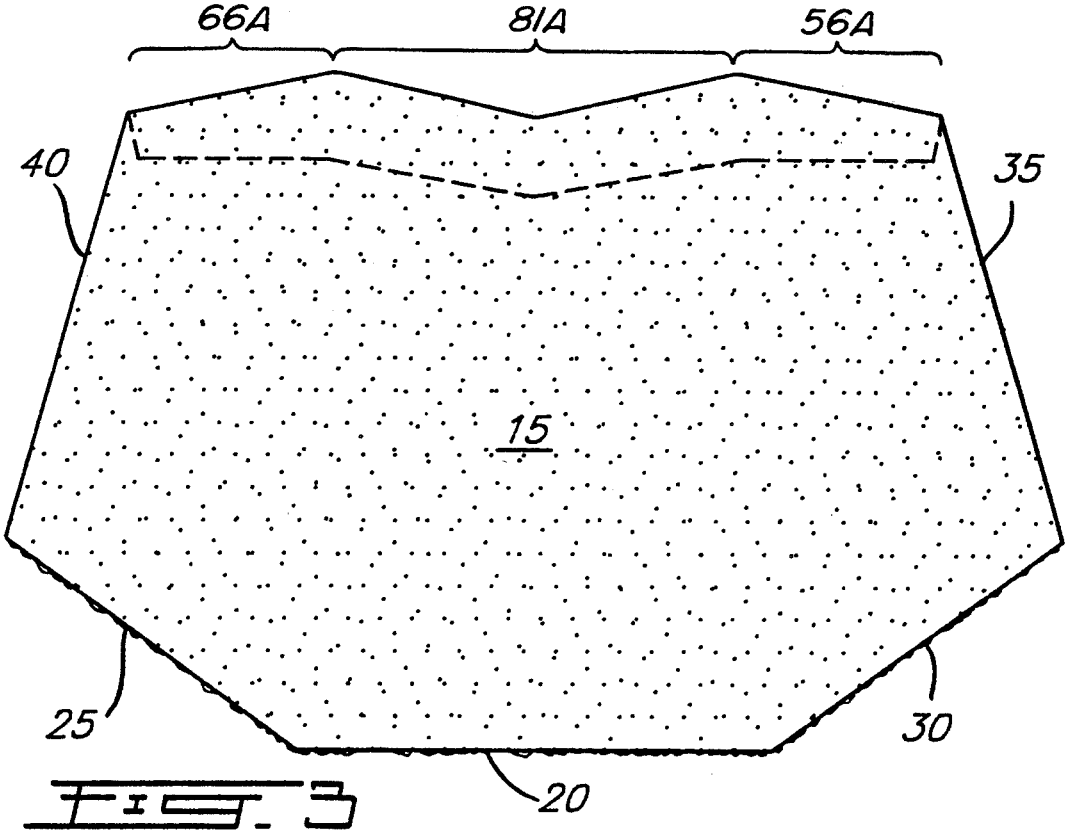
FIG. 3 is a plan view of the block shown in FIG. 1.

With reference to FIGS. 1 to 3, the front surfaces of the block 5 is being formed by faces 20, 25 and 30, the rear face, generally referred to as face 45 and the lateral faces by faces 35 and 40. The protrusion 50 extends outwardly and away from the surface 10. The protrusion 50 is used as guiding means or an interlocking member in accordance with the present invention. The protrusion 50 is elongated and formed generally of two sections, the first being the rear face 45 itself of the block 5 and the second, being the interlock surface 50A. The protrusion 50 which, in the embodiment shown is integral with the bottom flat surface 10 of the block 5 can be formed of a piece of concrete, plastic or similar material added to the surface 10 or otherwise fixed to same. The guiding means in accordance with the present invention is obtained by a combination of the protrusion 50 and more particularly by the interlock surface 50A and the rear face 45 as it will be appreciated hereinafter.

Figure 4:
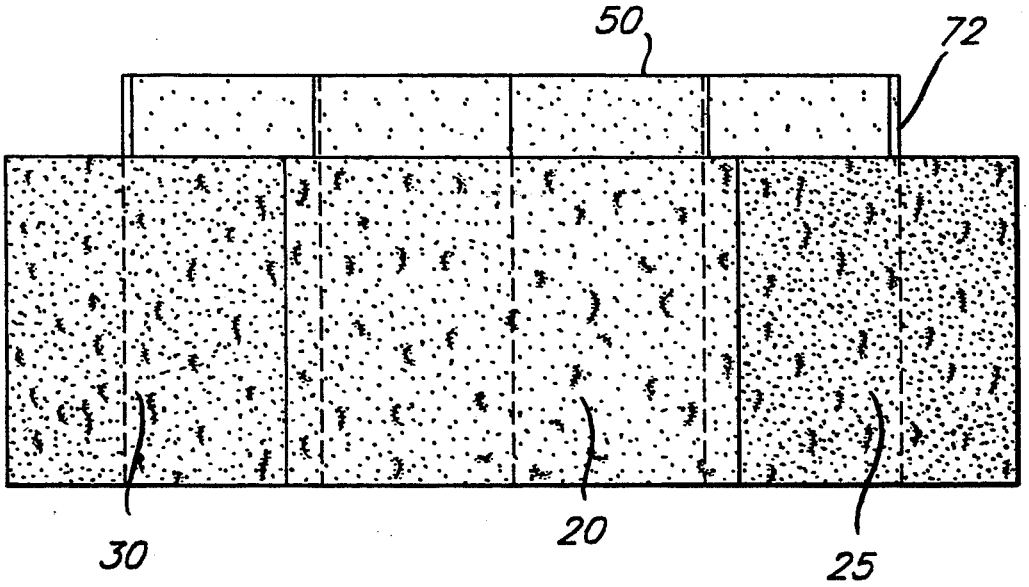
FIG. 4 is a front elevational view of the block shown in FIG. 1.
Figure 5:
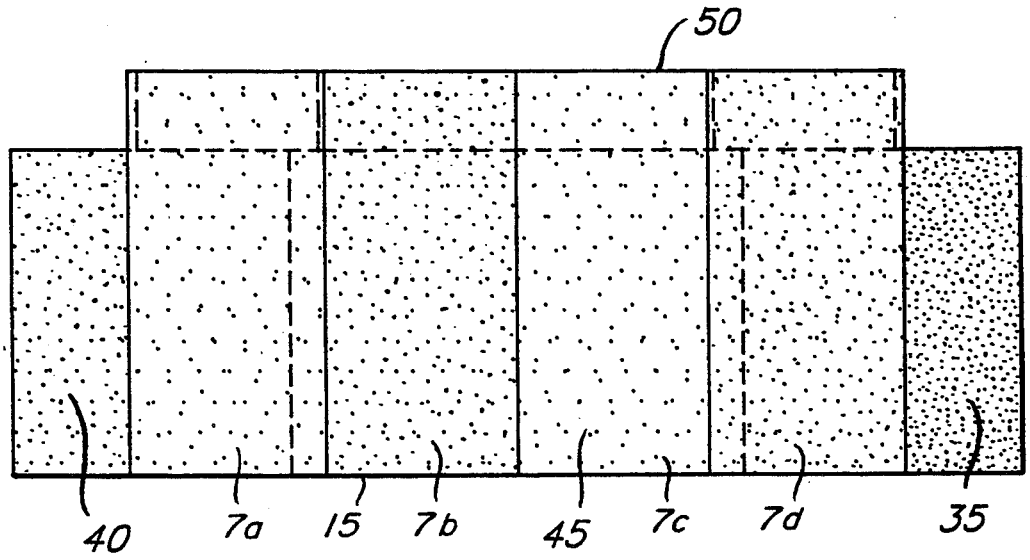
FIG. 5 is a rear elevational view of the block shown in FIG. 1.

As shown in FIGS. 4 and 5, the protrusion 50 extends for approximately one third of the total height of faces 20, 25, 30, 35, 40 and 45. The height 72 of the protrusion 50 is irrelevant *per se* since it is mainly used to support or guide the rear face 45 of each block of a particular course of blocks in the construction of decorative walls. Therefore, the said height 72 should be sufficient to accommodate that particular realization. However, if the block 5 is used for the construction of a retaining wall, since same can be the subject of greater horizontal pressure, the height 72 should be increased accordingly. The protrusion 50 is generally perpendicular to the bottom surface 10.

In a preferred embodiment and as shown in the enclosed figures, the interlock surface 50A is subdivided into four faces 55A, 60A, 65A and 70A. These faces are mainly used to guide the displacement of each and every block of a subsequent course of blocks as it will be appreciated particularly with reference to FIGS. 8 to 13. For the sake of clarity, in figures 11 to 13, the remaining of the block have been omitted. The displacement of one block 5 with respect to the other can be achieved laterally, that is, along the axis of the protrusion 50 or by a rotation along an axis somewhat perpendicular to the top 15 and bottom 10 surfaces of the block 5.

Figure 6:
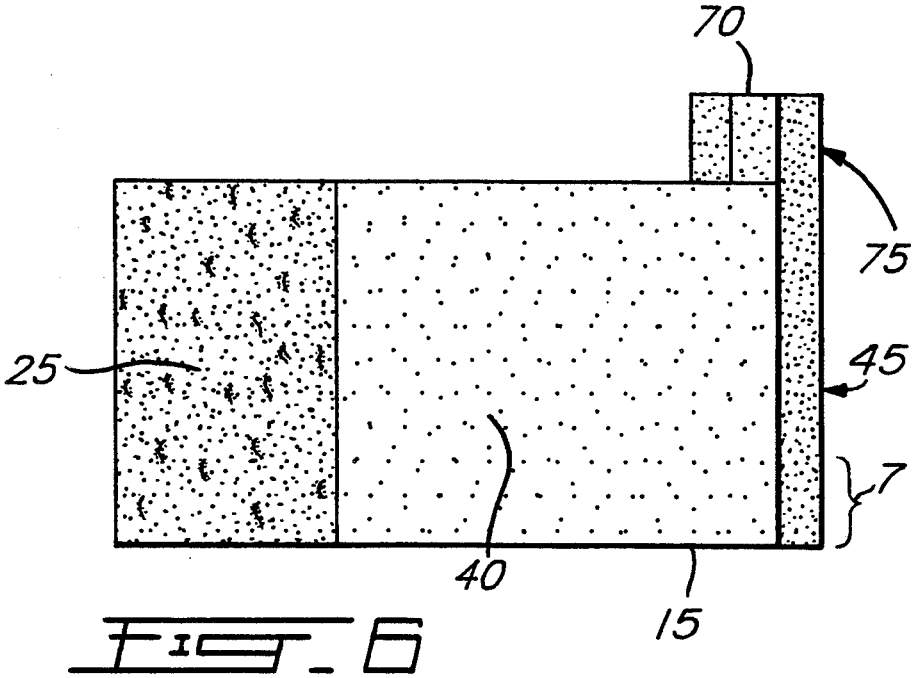
FIG. 6 is a right side view of the block shown in FIG. 1.
Figure 7:
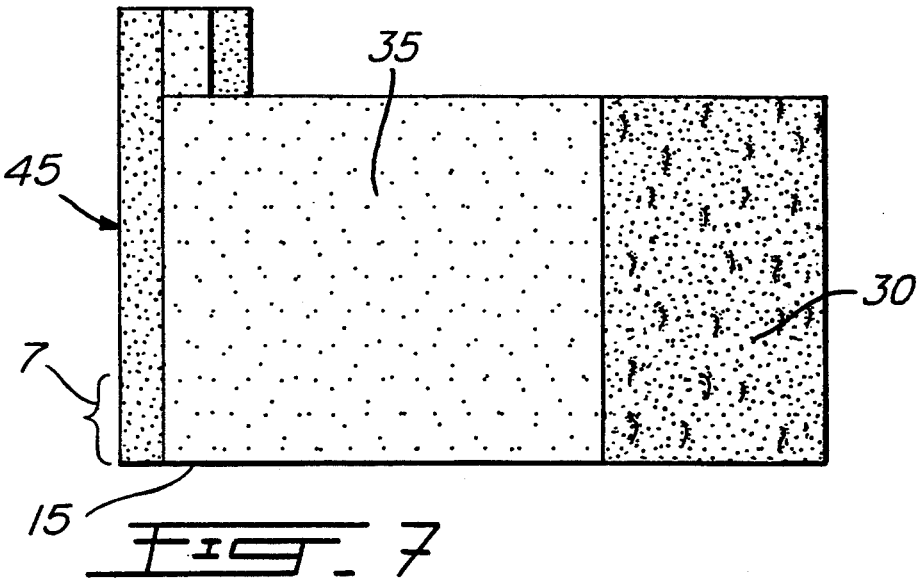
FIG. 7 is a left side view of the block shown in FIG. 1.

Referring to FIGS. 6 and 7, the rear surface 45 of the block 5, adjacent the top surface 15, has an upper edge surface portion which is indicated generally by the reference numeral 7. Referring back to FIGS. 3 and 5, the rear surface 45 including the upper edge surface portion 7, has bevelled portions 56A and 66A adjacent respective side surfaces 35 and 40 of the block 5 and a recessed portion 81A disposed between the bevelled portions 56A and 66A; the upper edge surface portion 7 is thus itself divided into four edge surface portions generally designated in FIG. 5 by the reference numerals *7a, 7b, 7c,* and *7d*.

With reference to FIGS. 8 to 13, there is shown a combination of blocks forming a wall in which the protrusion 50 (shown in dotted line in FIGS. 8 to 10) of each block of a subsequent (referred to as S in the figures) course of blocks and more particularly faces 55A, 60A, 65A and 70A of same rests on the rear face 45 of a block from a next below (referred to as N in the figures) course of blocks. By providing complementary faces 50A and 45, a large number of different positions can be obtained simply by rotating or by displacing a block with respect of another adjacent block while permitting relative movement between same. To assure that the wall so erected is aesthetic pleasing, the block 5 of the subsequent S course of blocks should be positioned so that the middle section of the face 20 covers symmetrically the vertical joint 22 formed with two blocks of the next below B course of blocks.

In order to build a wall, the soil is excavated to a depth corresponding to the height of the protrusion 50 in order to receive the first course of blocks 5. It will be appreciated that a particular block 5 can be provided for the first course without the protrusion 50 or same can be grinded or removed from the surface 10 of the block. By so doing, the excavation is not necessary to accommodate the first course of blocks. However, the protrusion 50 of the first blocks forming the first course of blocks can also be embedded in the ground to be retained and forms an anchor for the blocks and for the wall to be erected.

As the erection of the wall takes place, it is necessary to fill in the gap created between the course of blocks and the soil. Such filling is usually made with soil, rocks or the like. The subsequent courses of blocks are successively laid above the lowermost courses including the offsetting of the vertical joints 22.

When several blocks according to the present invention are superimposed as described hereinbefore, the length 70 and the height 75 of the protrusion 50 determine the angle of inclination of the wall, therefore, by selecting a particular thickness of the protrusion 50, an appropriate inclination from the vertical can be automatically established upon the erection of such structure as shown in FIGS. 8 to 13. Hence, varying the said length 70 and the height 75 of the block allows adjustment of the inclination of the said wall.

Figure 8:
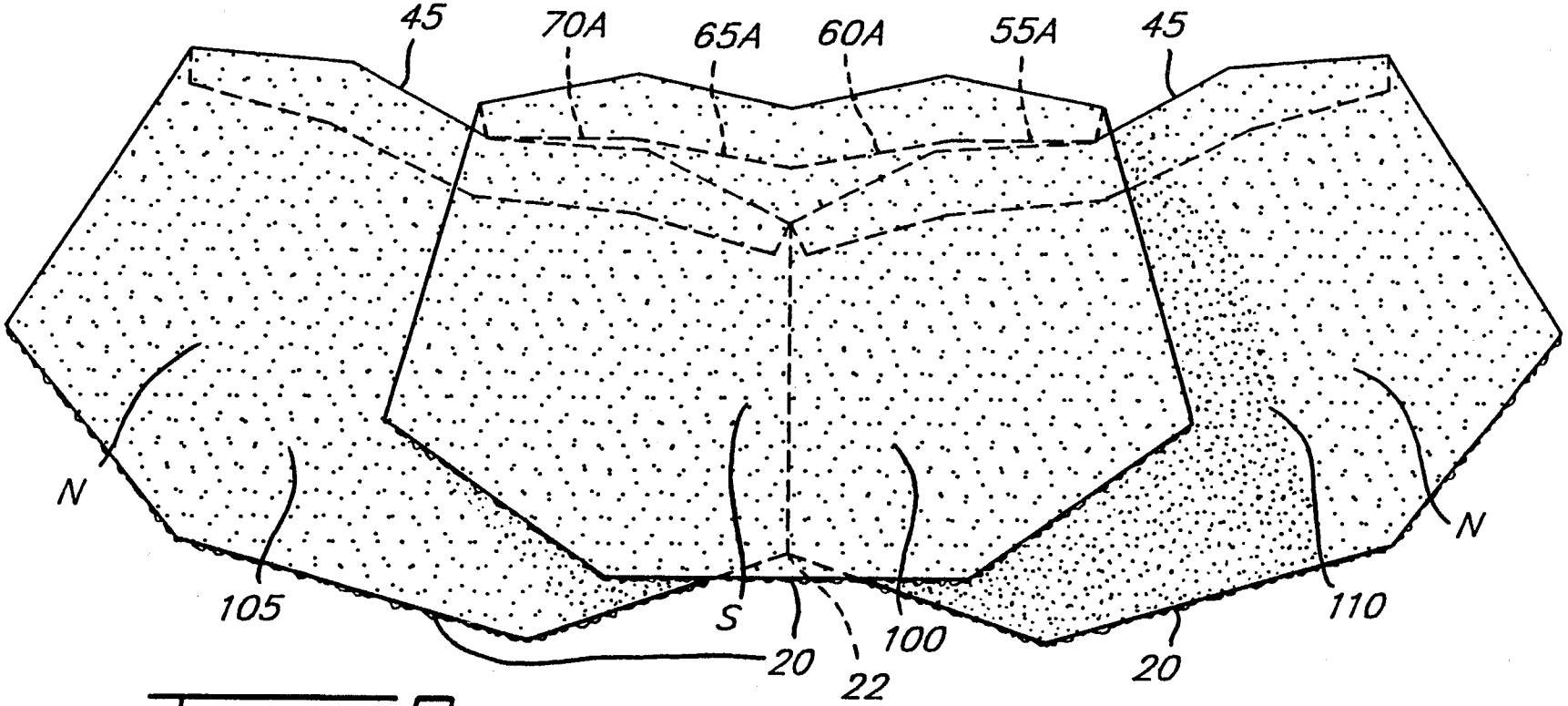
FIG. 8 is a top view showing three blocks forming a rounded (convex) wall.
Figure 9:
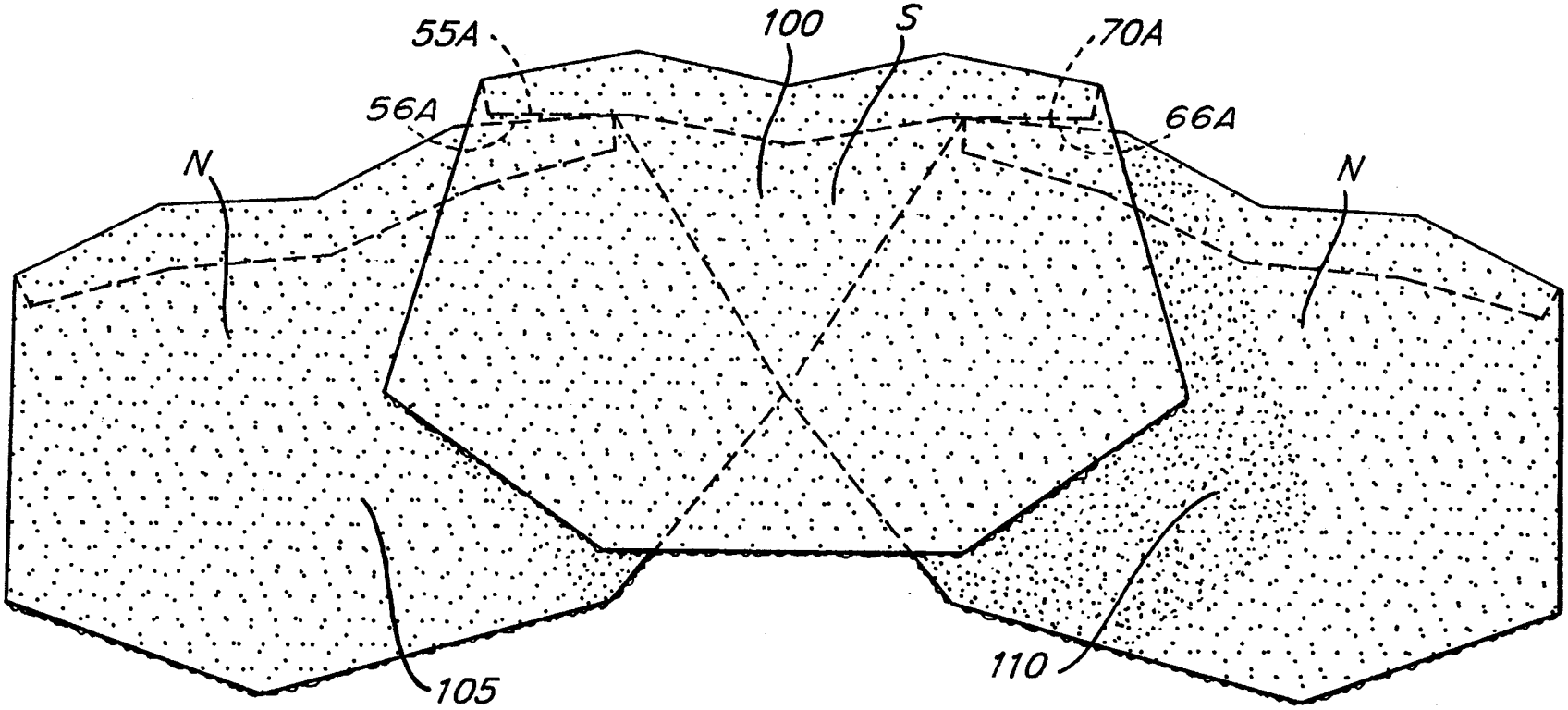
FIG. 9 is a top view showing three blocks forming a rounded (concave) wall.

With the construction blocks of the type described various forms of wall construction are possible, but the two general types are illustrated at present in FIGS. 8 and 9. In FIG. 8 there is shown a plan view of three blocks forming a convex wall. As shown, the block 100 of the subsequent course of blocks S is disposed on the two blocks 105 and 110 of the next N below course of blocks and the projection 50 and more particularly faces 55A and 70A of the block 100 rests on, respectively, the rear faces 45 of blocks 110 and 105. As mentioned previously, the block 100 should be displaced so that the vertical joint 22 is symmetrically covered. In FIG. 9, there is shown a concave wall wherein the protrusion 50 of block 100 on the subsequent S course of blocks rests on the rear face of the blocks 105 and 110 of the next N below course of blocks. The block 100 is disposed over the joint between two underlying blocks 105 and 110 (see FIG. 9) so as to define a curved wall segment having a concave exterior wall surface. A portion of the surfaces 55A and 70A of the block 100 is able to engage a respective bevelled portion 56A and 66A of the upper edge surface portion of each of the underlying blocks 105 and 110 such that the front surface of the block 100 is offset rearwardly with respect to the front surfaces of the underlying blocks 105 and 110. Similarly, a curved wall having a convex exterior shape can be obtained in accordance with the present invention (see FIG. 8).

Figure 10:
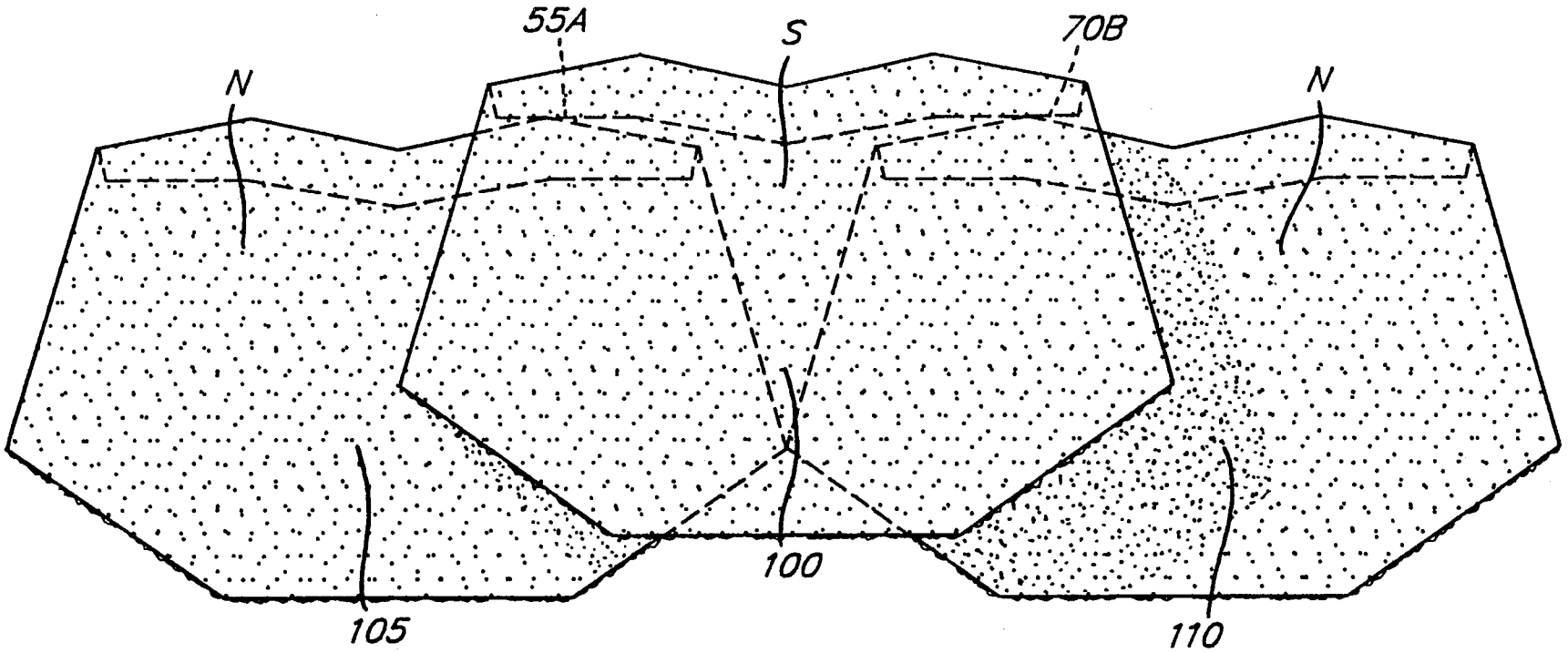
FIG. 10 is a top view showing three blocks forming a flat wall.

With respect to FIG. 10, a fiat wall is illustrated and is formed of the blocks 100, 105 and 110.

Figure 11:
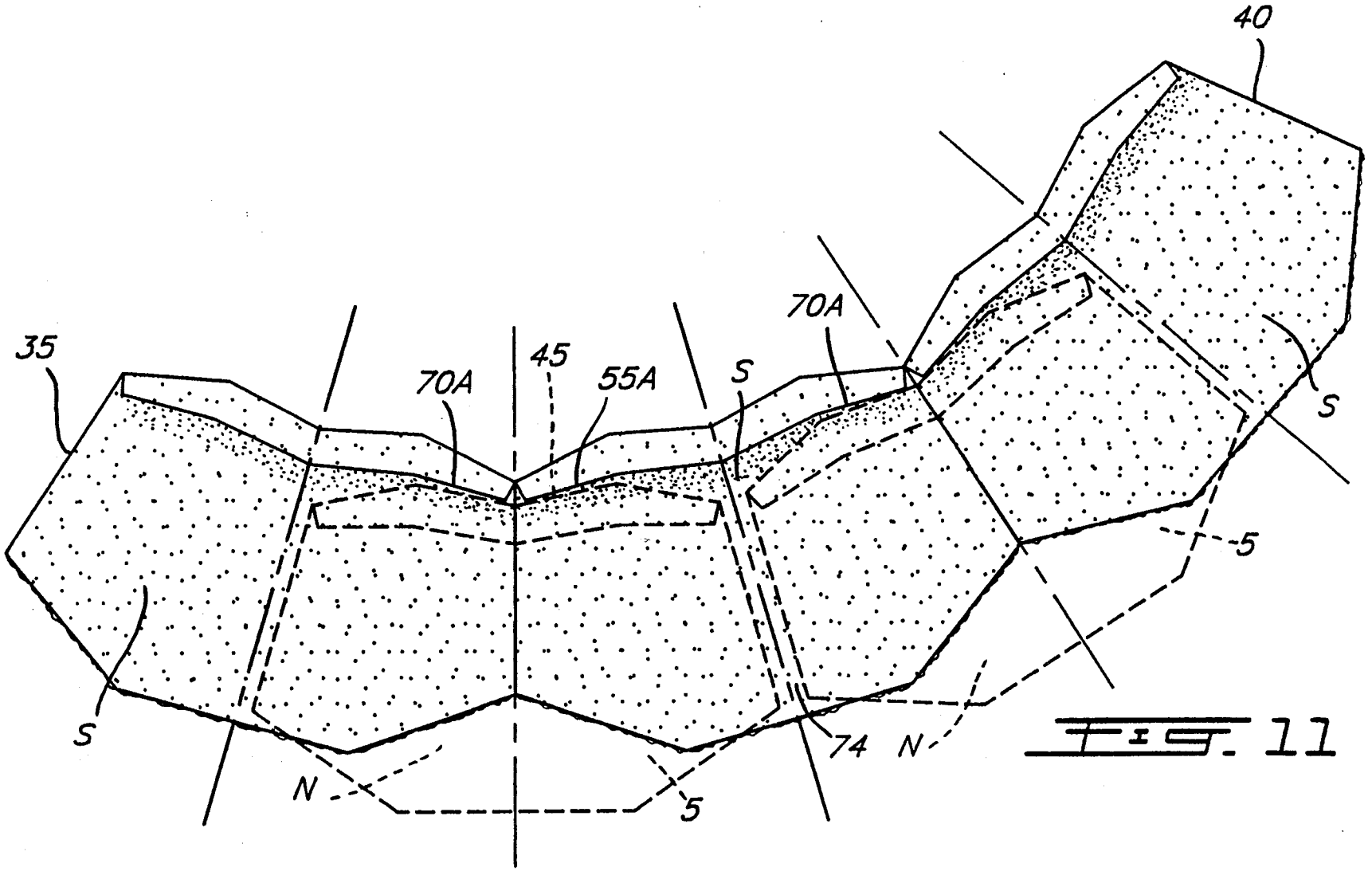
FIG. 11 is a bottom view showing five blocks forming a concave wall.

In FIG. 11, there is shown a portion of a rounded wall. It is to be noted that the view shown is a bottom view. In this embodiment, the blocks 5 of the first course of blocks are disposed on the ground as explained above. As it will be appreciated hereinafter, in some configurations, a certain distance 74 should be provided between each and every block of the below courses of blocks due to the backward movement of one course with respect of the other created by the protrusion 50. The value of the distance 74 must take into account the thickness of the protrusion 50, the frontal length of the block 5 and the number of courses of blocks to form the wall. A example of the computation of the distance 74 will be provided hereinafter. After the first course is placed, then, the second subsequent S course of blocks is laid upon the first course by resting faces 55A, 60A, 65A or 70A on the rear face 45 of the block 5 of the first course of blocks.

Figure 11A:
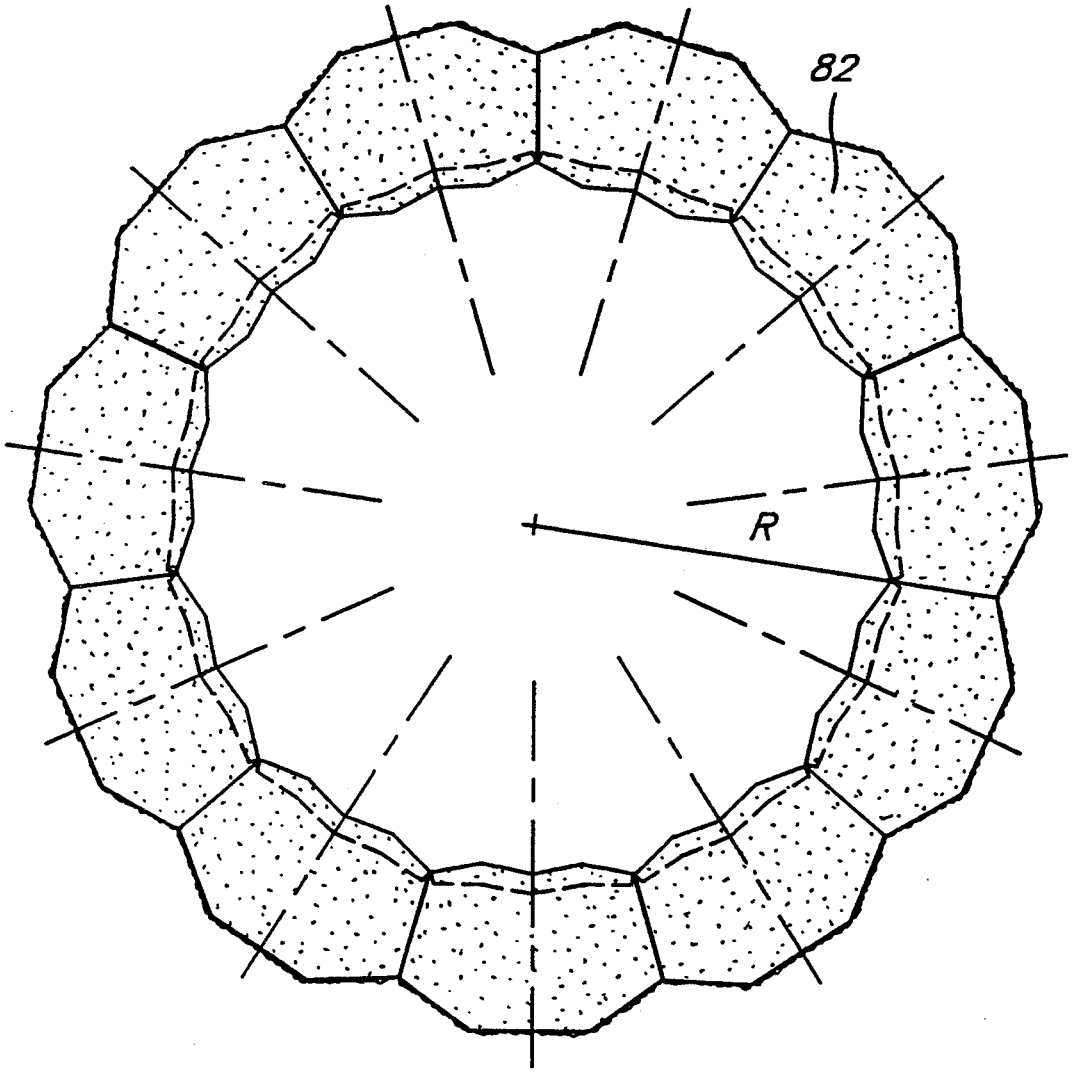
FIG. 11A is a top view showing the uppermost course of blocks of a rounded wall.

In FIG. 11A, there is shown a top view of a completed rounded wall (only the uppermost course of blocks being illustrated). An example of the method to obtain such a configuration will be given. As indicated above, due to the backward movement of one course of block with respect the next below course, in certain configurations, such as the one illustrated in FIG. 11A, a distance must be provided between the blocks of the courses of blocks below the uppermost course. Since in the uppermost course of blocks, it is aesthetically preferable not to have any distance between two blocks, it is to be understood that for a given length 82 of a block 5, the value of the radius R of the circle is obtained as follow:

$$R\ min = P/(2*Pi)$$

where:

R min :radius of the circle for the uppermost course (in.)

P :perimeter of the circle for the uppermost course(in.)

Pi:3.1416

P being obtained by multiplying the number of blocks per course for the uppermost course, that is 12, by the length 82 which is 12 inches for a given block. Therefore P=144 in..

Then, R min=22.92 in.

A typical backward movement of each course of blocks with respect to the next lower course is 1.14 in. This distance represent the length 70 shown in FIG. 6. Therefore, for the second course of blocks, the radius R2 will be:

$$R2 = R\ min + 1.14 \text{ in.}$$

$$R2 = 24.06 \text{ in.}$$

Then, the perimeter P2 for this second course is:

$$P2 = 2*Pi*R2$$

$$P2 = 151.16 \text{ in.}$$

Therefore, the total distance D is:

$D=P2-P$ $D=7.16$ in.

Which represents, for each block:

$d=D/12$ $d=0.6$ in

For each and every course of blocks the distance 74 between each block 5 will be increased by 0,6 in per course.

Figure 12:
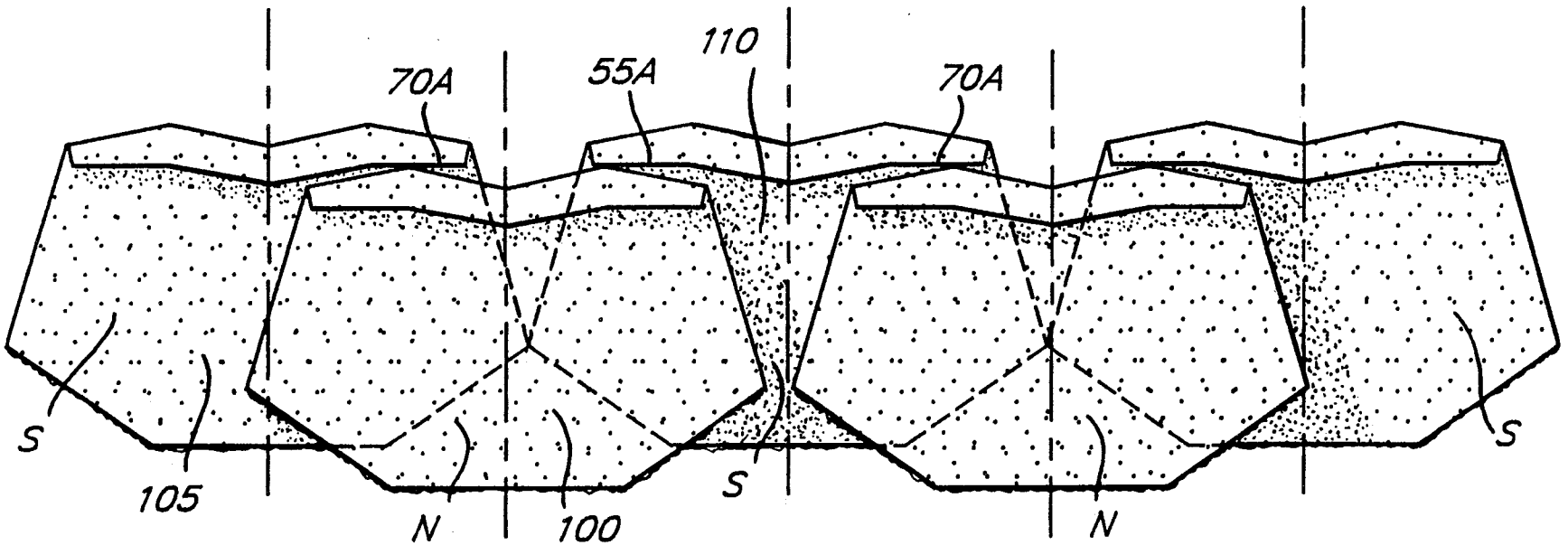
FIG. 12 is a bottom view showing five blocks forming a flat wall.

In FIG. 12, there is shown a bottom view of a flat wall. As indicated above, the first course (corresponding to N on FIG. 12) of block is laid on the ground, then the second and subsequent S courses are laid upon said first course by resting faces 70A and 55A, respectively of blocks 105 and 110 of the second course on the rear face 45 of block 100 from the first course.

Figure 13:
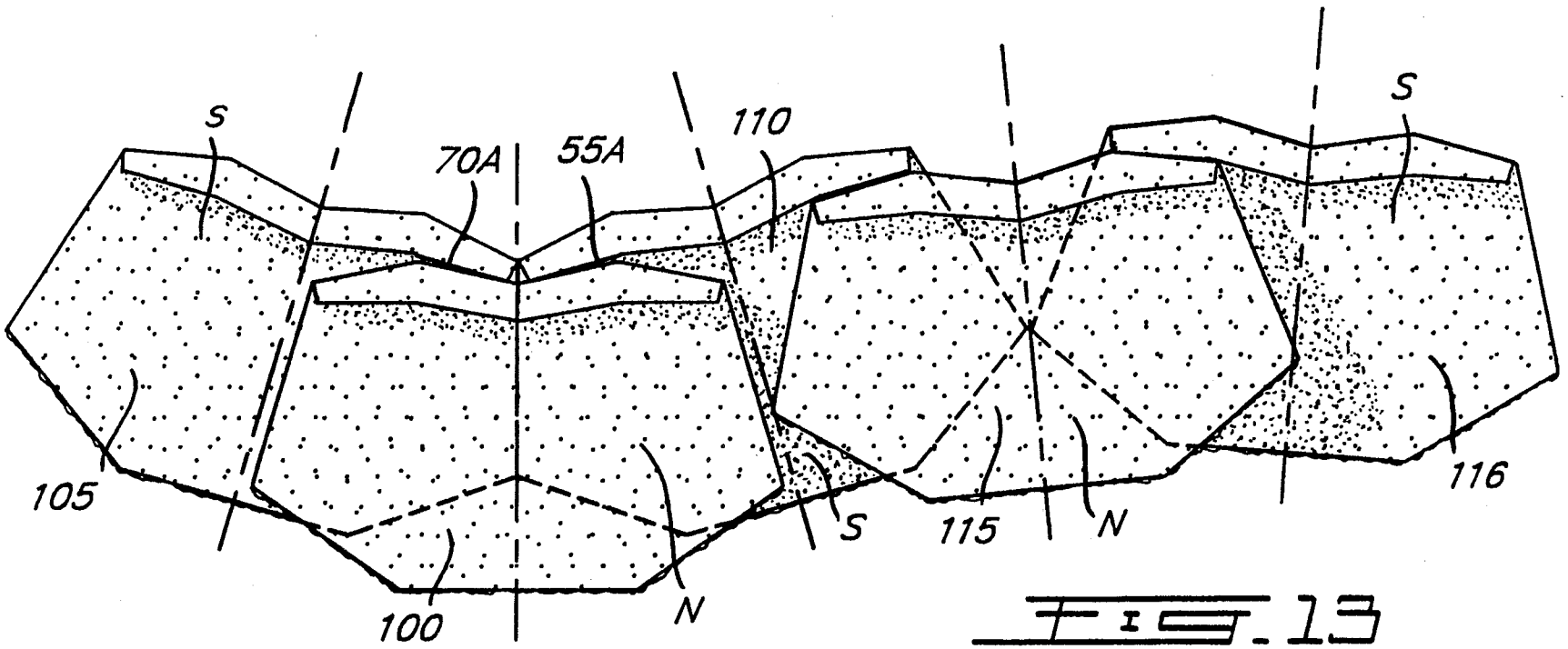
FIG. 13 is a bottom view showing five blocks forming a combination of a rounded and a flat wall.

In FIG. 13, there is shown a bottom view of a wall combining a flat and a rounded configurations. As previously mentioned, the first course N of blocks, in this FIG. 13, blocks 100 and 115, is laid on the ground. Then, the subsequent course of blocks 105, 110 and 116 is positioned on the first course.

It will be obvious to persons skilled in this field that other block dimensions can be selected. It is preferable that the block be manufactured from a strong concrete. However, the blocks can also be manufactured of wood, metal, plastic, fiberglass or other materials that can be shaped or molded according to the above described embodiments. Also, other dimensions can be used and larger blocks can be produced for larger applications.

Figure 14:
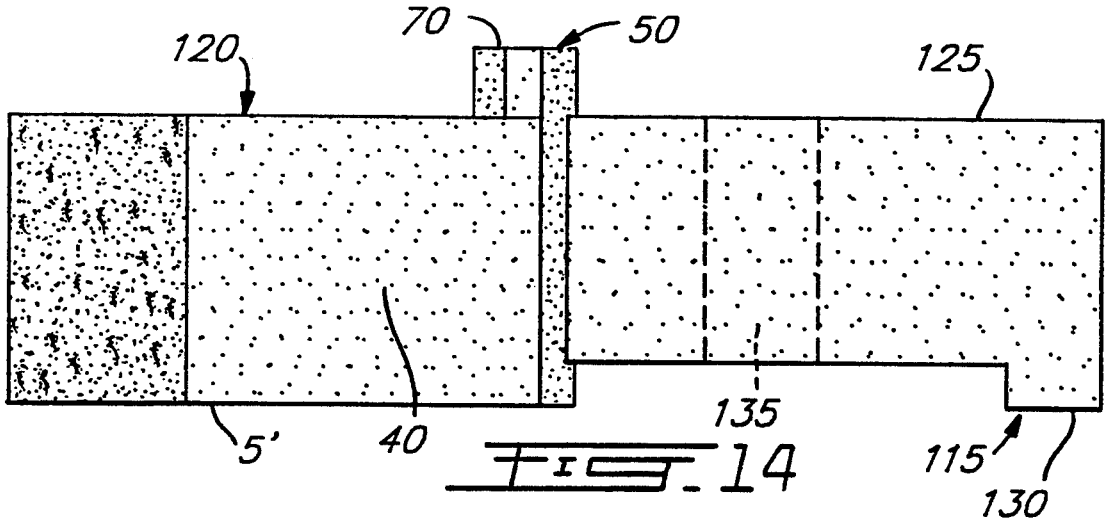
FIG. 14 is a right side view of a second embodiment of the block of the present invention.
Figure 14A:
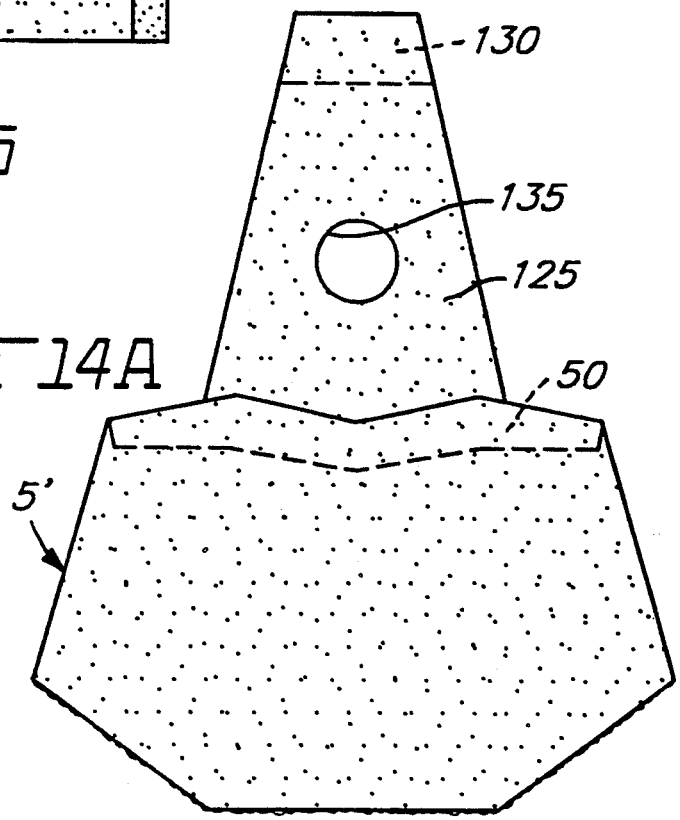
FIG. 14A is a bottom view of the block shown in FIG. 14.
Figure 16:
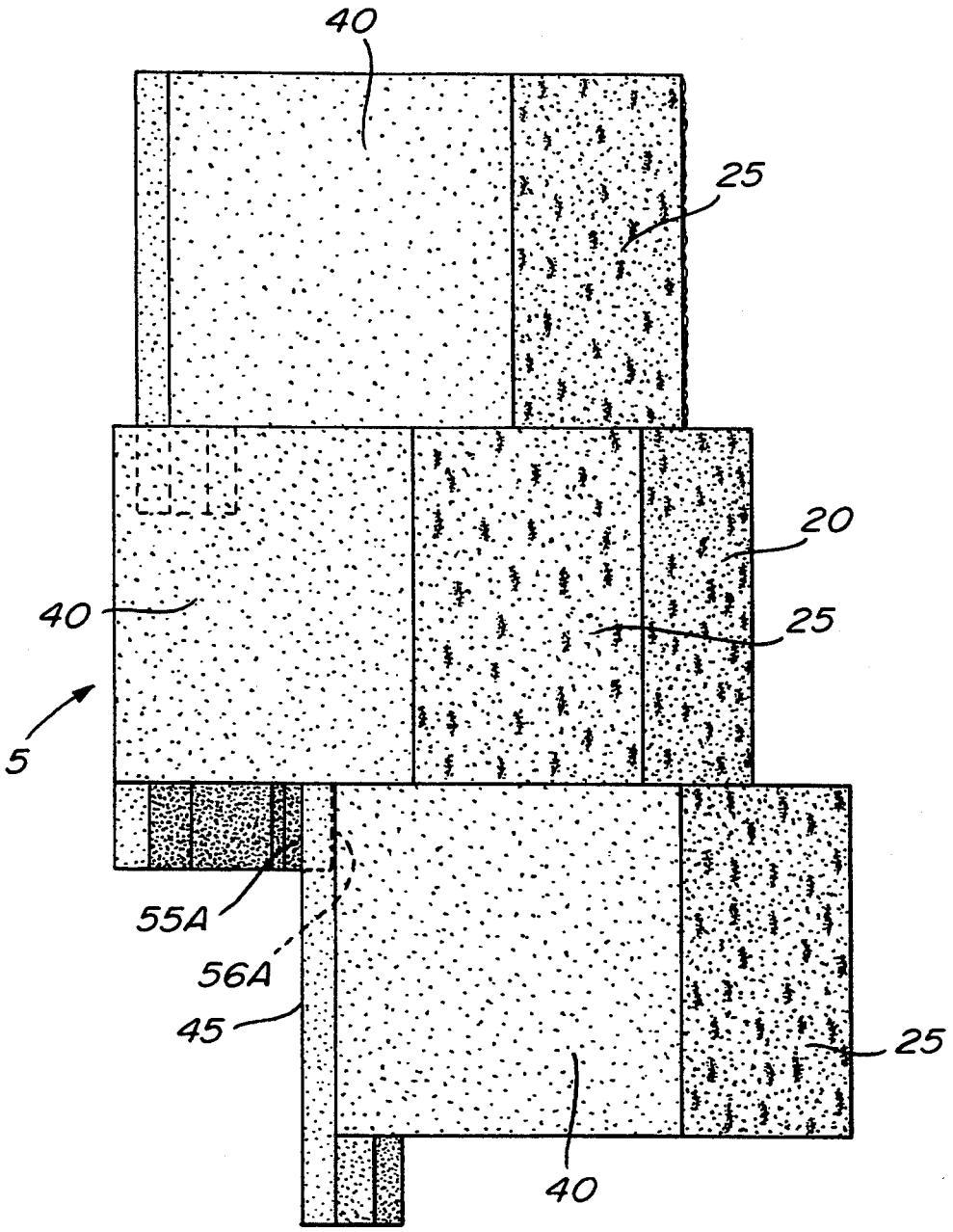
FIG. 16 is a left side view of a wall erected in accordance with the present invention.

The block 5 shown and described above are mainly for the construction of decorative walls. However, for the construction of a retaining wall, anchor blocks should be used so as to achieve a better reinforcement against a forward displacement of the blocks. In FIGS. 14 and 14A a block 5' is shown where a special anchoring means 115 is used. These one piece moulding is provided with a head piece 120 which corresponds to the configuration and contours of the block 5 and also includes the guiding means 50 of the present invention. In a preferred embodiment, on the side of the earth an anchoring end 125 in the form of a concrete beam adjoins and is provided at its free end with and anchorage 130. In a second embodiment, the anchoring end 125 of the anchoring block 5' can be provided with opening 135. By filling the said opening 135 with soil, rocks or the like, the anchoring block 5' is made so heavy that it will not slide out of place and is able to resist the large forwardly directed slop pressures.

Figure 15:
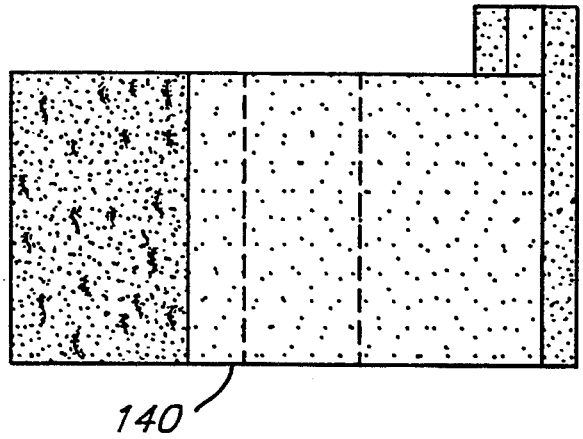
FIG. 15 is a right side view of a third embodiment of the block of the present invention.

It will be understood further that variations or modifications can be undertaken in the module illustrated and described by those skilled in the art without departing from the spirit and scope of the invention as defined by the appended claims. For example, the dimensions mentioned above are given for the sake of clarity only and should not be construed as limiting the invention in any way. In order to lighten the weight of the block 5 (see FIG. 15), a vertical opening 140 can be formed therein. In addition, in the embodiment illustrated, the front surfaces 20, 25 and 30 display a regular, flat surface, however, the said front surfaces may be provided with a pebbled surface, facing of bricks or any other surfaces.

In the foregoing description certain terms have been used for brevity, clearness and understanding, but no necessary limitations are to be implied therefrom beyond the requirements of the prior art, because such words are used for descriptive purposes herein and are intended to be broadly construed.

The embodiments of the invention in which an exclusive property or privilege is claimed are defined as follows:

1. An interlocking block for use in the construction of a mortarless retaining wall wherein a plurality of said interlocking blocks are stacked in a number of successive offset courses of blocks, a block in an upper row being in overlapping relation with respect to the joint between blocks in an immediately underlying row, said interlocking block comprising a block body; and an interlocking member, said block body having top and bottom support surfaces and rear, front and side surfaces, said interlocking member projecting from the bottom surface of the interlocking block adjacent the rear surface thereof, the rear surface of the interlocking block having an upper edge surface portion adjacent the top surface, said interlocking member having an interlock surface configured so that when said interlocking block is disposed over the joint between two said underlying interlocking blocks, the interlock surface is able to engage said upper edge surface portion of each such underlying block such that the front surface of the block is offset rearwardly with respect to the front surfaces of the underlying blocks, characterized in that said upper edge surface portion has a bevelled portion adjacent each side surface of the block and a recessed portion disposed between the bevelled portions, said bevelled and recess portions being configured such that i) when said interlocking block is disposed over the joint between two underlying said interlocking blocks so as to define a curved wall segment having a concave exterior wall surface, a portion of said interlock surface adjacent each side surface of the interlocking block is able to engage a respective bevelled portion of the said upper edge surface portion of each such underlying interlocking block such that the front surface of the interlocking block is offset rearwardly with respect to the front surfaces of the underlying interlocking blocks; and ii) when said interlocking block is disposed over the joint between two underlying said interlocking blocks so as to define a curved wall segment having a convex exterior wall surface, a portion of said interlock surface adjacent each side surface of the interlocking block is able to engage a respective recessed portion of the said upper edge surface portion of each such underlying interlocking block such that the front surface of the interlocking block is offset rearwardly with respect to the front surfaces of the underlying interlocking blocks.

2. An interlocking block as described in claim 1 wherein said interlocking member is integral with said rear surface.

3. An interlocking block as described in claim 1 wherein said interlock surface is divided into four faces.

4. An interlocking block as described in claim 1 wherein said block is generally hexagonal in shape.

5. An interlocking block as described in claim 1 wherein said block comprises anchoring means.

6. An interlocking block as described in claim 5 wherein said anchoring means extends from the rear surface of said block body.

7. An interlocking block for use in the construction of a mortarless retaining wall wherein a plurality of said interlocking blocks are stacked in a number of successive offset courses of blocks, a block in an upper row being in overlapping relation with respect to the joint between blocks in an immediately underlying row, said interlocking block comprising a block body; and guiding means, said block body having top and bottom support surfaces and rear, front and side surfaces, said guiding means projecting from the bottom surface of the interlocking block adjacent the rear surface thereof, the rear surface of the interlocking block having an upper edge surface portion adjacent the top surface, said guiding means having an interlock surface configured so that when said interlocking block is disposed over the joint between two said underlying interlocking blocks, the interlock surface is able to engage said upper edge surface portion of each such underlying block such that the front surface of the block is offset rearwardly with respect to the front surfaces of the underlying blocks, characterized in that in that said upper edge surface portion has a bevelled portion adjacent each side surface of the block and a recessed portion disposed between the bevelled portions, said bevelled and recess portions being configured such that:

i) when said interlocking block is disposed over the joint between two underlying said interlocking blocks so as to define a curved wall segment having a concave exterior wall surface, a portion of said interlock surface adjacent each side surface of the interlocking block is able to engage a respective bevelled portion of the said upper edge surface portion of each such underlying interlocking block such that the front surface of the interlocking block is offset rearwardly with respect to the front surfaces of the underlying interlocking blocks; and ii) when said interlocking block is disposed over the joint between two underlying said interlocking blocks so as to define a curved wall segment having a convex exterior wall surface, a portion of said interlock surface adjacent each side surface of the interlocking block is able to engage a respective recessed portion of the said upper edge surface portion of each such underlying interlocking block such that the front surface of the interlocking block is offset rearwardly with respect to the front surfaces of the underlying interlocking blocks.

8. An interlocking block as described in claim 7 wherein said guiding means is integral with said rear surface.

9. An interlocking block as described in claim 7 wherein said interlock surface is divided into four faces.

10. An interlocking block as described in claim 7 wherein said block is generally hexagonal in shape.

11. An interlocking block as described in claim 7 wherein said block comprises anchoring means.

12. An interlocking block as described in claim 11 wherein said anchoring means extends from the rear surface of said block body.

13. An interlocking block as described in claim 11 wherein said anchoring means comprises a vertical opening formed therein.

* * * * *